United States Patent [19]

Delesandri

[11] 4,442,892

[45] Apr. 17, 1984

[54] APPARATUS FOR STABBING AND THREADING A SAFETY VALVE INTO A WELL PIPE

[76] Inventor: Domenico Delesandri, 3319 Delesandri, P.O. Box 428, League City, Tex. 77573

[21] Appl. No.: 408,443

[22] Filed: Aug. 16, 1982

[51] Int. Cl.[3] ..... E21B 19/16

[52] U.S. Cl. ..... 166/85; 137/315; 29/237

[58] Field of Search ..... 166/85, 77.5, 363, 364, 166/386; 137/315, 15; 29/237, 240; 285/18

[56] References Cited

U.S. PATENT DOCUMENTS

| | | | |
|---|---|---|---|
| 1,831,878 | 11/1931 | Myracle | 166/85 |
| 3,505,913 | 4/1970 | Dickmann et al. | 81/57.35 |
| 3,625,282 | 12/1971 | Bridges et al. | 166/92 X |
| 3,877,529 | 4/1975 | Litchfield | 166/77.5 X |
| 4,026,354 | 5/1977 | Burrow | 166/95 |
| 4,291,762 | 9/1981 | Gudgel | 166/85 |

*Primary Examiner*—Ernest R. Purser
*Assistant Examiner*—Thuy M. Bui
*Attorney, Agent, or Firm*—Arnold, White & Durkee

[57] ABSTRACT

In accordance with an illustrative embodiment of the present invention, an apparatus for stabbing and threading a safety valve into a well pipe to prevent upward flow comprises a tubular canister rotably mounted on a carriage assembly that is slidably mounted on an upstanding frame. The lower end of the frame has a swivel mounting to a bracket that is attached to the side of an elevator-type clamp means by which the apparatus is clamped onto the upper end portion of the pipe. With the canister pivoted into position over the pipe, a gear drive is operated by a hand wheel to cause the canister to be rotated and simultaneously lowered toward the pipe whereby a safety valve mounted inside the canister is automatically threaded into the upper end of the pipe and can be closed to shut off upward flow.

17 Claims, 5 Drawing Figures

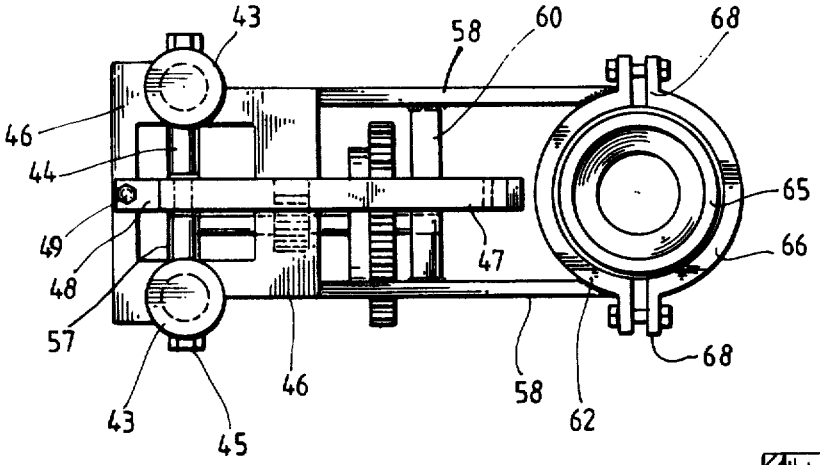
Fig. 2
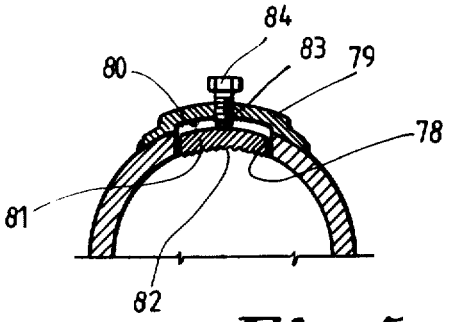
Fig. 5
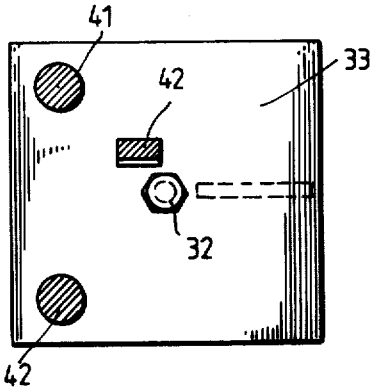
Fig. 3
Fig. 4
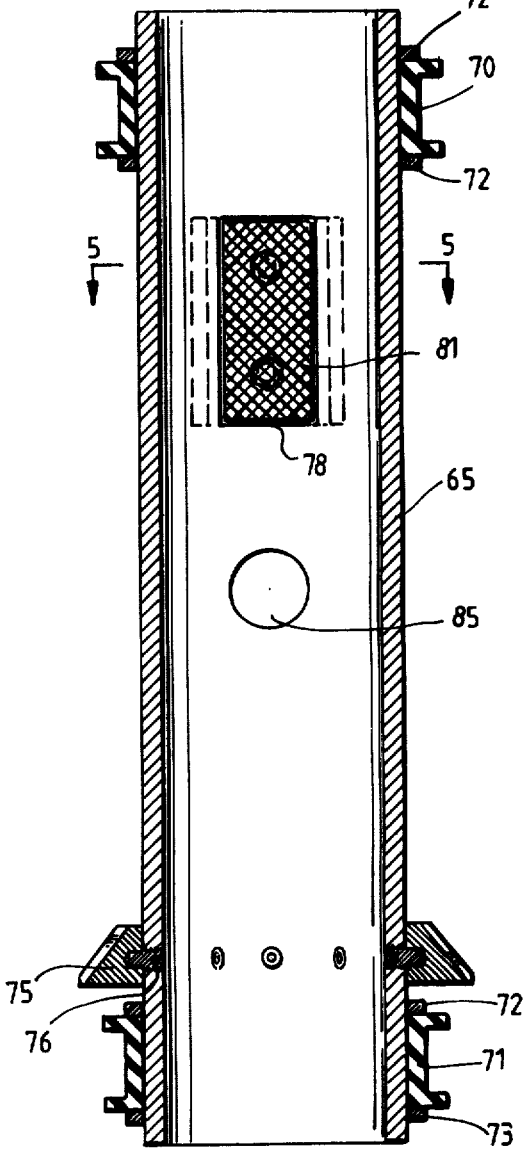

APPARATUS FOR STABBING AND THREADING A SAFETY VALVE INTO A WELL PIPE

FIELD OF THE INVENTION

This invention relates to a new and improved apparatus for coupling a safety valve to the top of a well conduit such as drill pipe through which well fluid is flowing, or is about to flow, in an uncontrolled manner.

BACKGROUND OF THE INVENTION

When during the drilling of an oil well the bit penetrates an earth formation having an unexpectedly high pressure, the hydrostatic head of the drill mud standing in the well may not be sufficient to prevent formation fluids from entering the bore hole and traveling upward toward the surface. If such flow is not controlled quickly, a "blow out" of the well can occur and create very serious safety hazards to personnel working on and around the drilling rig. Of course a resulting fire can cause tremendous damage to the drilling equipment. At first indication of possible blow out conditions, the blow out preventers can be closed around the drill pipe to seal off the annulus. If the kelly by which the drill pipe is driven happens to be attached to the upper end of the string of drill pipe, a valve may be present in the system which can be closed to shut off upward flow through the drill pipe itself.

However, should upward flow begin while the kelly is not connected to the drill pipe, for example while a threaded connection between pipe sections is being made, a very hazardous situation is presented for which applicant knows of no adequate apparatus available to quickly and conveniently control the flow. U.S. Pat. No. 4,026,354 issued May 31, 1977 shows a somewhat massive device that is lowered over the open end of the pipe by a crane or a boom and operated by a long drive shaft that extends through a kill line in order to make a connection with the pipe and enable a shut-off valve to be closed. Due to its massive nature, this device could not be positioned and put into operation as quickly as would obviously be desirable under the circumstances. U.S. Pat. No. 3,625,282 issued Dec. 7, 1971 shows a device having a clamp that mates only with a special type of groove arrangement on the upper end of the casing, the clamp having bolt holes that can be aligned with matching holes on the lower flange of a spool which mounts a master valve. The clamp and spool have an offset hinge bolt to enable the spool to be pivoted into position. However this apparatus requires the make up of numerous bolts before complete attachment can be accomplished, which is time consuming and thus potentially dangerous, and the clamp assembly is designed for attachment only to a specific type of machined end fitting.

It is the general object of the present invention to provide a new and improved safety apparatus that can be quickly and conveniently attached to the upper end of the drill pipe or similar conduit and which enables a valve to be threaded into the pipe and then closed to prevent upward flow.

SUMMARY OF THE INVENTION

These and other objects are attained in accordance with the concepts of the present invention through the provision of apparatus comprising an elevator-type clamp adapted to be releasably secured to the upper end of the drill pipe extending into the well. A bracket on the clamp mounts a swivel base to the side thereof defining a vertical pivot axis that is laterally offset from and parallel to the longitudinal axis of the drill pipe. A frame assembly that includes upstanding guide rods is pivotally mounted on the swivel base, and a carriage is slidably mounted on the guide rods of the frame assembly. The carriage has a tubular canister rotatably mounted thereon and which is adapted to house a flow control device such as a ball-type safety valve. The frame assembly, carriage and canister thus can be pivoted between a first position where the canister and safety valve are misaligned with the drill pipe and the second position where the longitudinal axes of the canister and safety valve are axially aligned with the drill pipe. Drive means are provided for simultaneously rotating the canister and lowering the same toward the clamp in order to automatically thread the safety valve into the threaded upper end of the drill pipe, so that the valve can be closed to shut off upward flow. Preferably the entire apparatus is adapted to be suspended in the derrick on a flexible line so that it can be quickly positioned adjacent to the upper end of the drill pipe and clamped thereto when emergency conditions arise. The canister and safety valve initially are pivoted to the misaligned position so that attachment of the clamp can be easily accomplished in the presence of upward flow. Then the operator pivots the assembly to the aligned position and operates the drive means to thread the valve into the drill pipe, whereupon the valve is closed to shut off upward flow.

BRIEF DESCRIPTION OF THE DRAWINGS

The present invention has other objects, features and advantages which will become more readily apparent in connection with the following detailed description of the preferred embodiment, taken in conjunction with the appended drawings in which:

FIG. 2 is a top view of the apparatus shown in FIG. 1;

FIG. 3 is a sectional view taken along line 3—3 of FIG. 1;

FIG. 4 is a longitudinal cross-sectional view of the canister; and

FIG. 5 is a fragmentary sectional view taken along 5—5 of FIG. 4.

DESCRIPTION OF A PREFERRED EMBODIMENT

Figure 1:
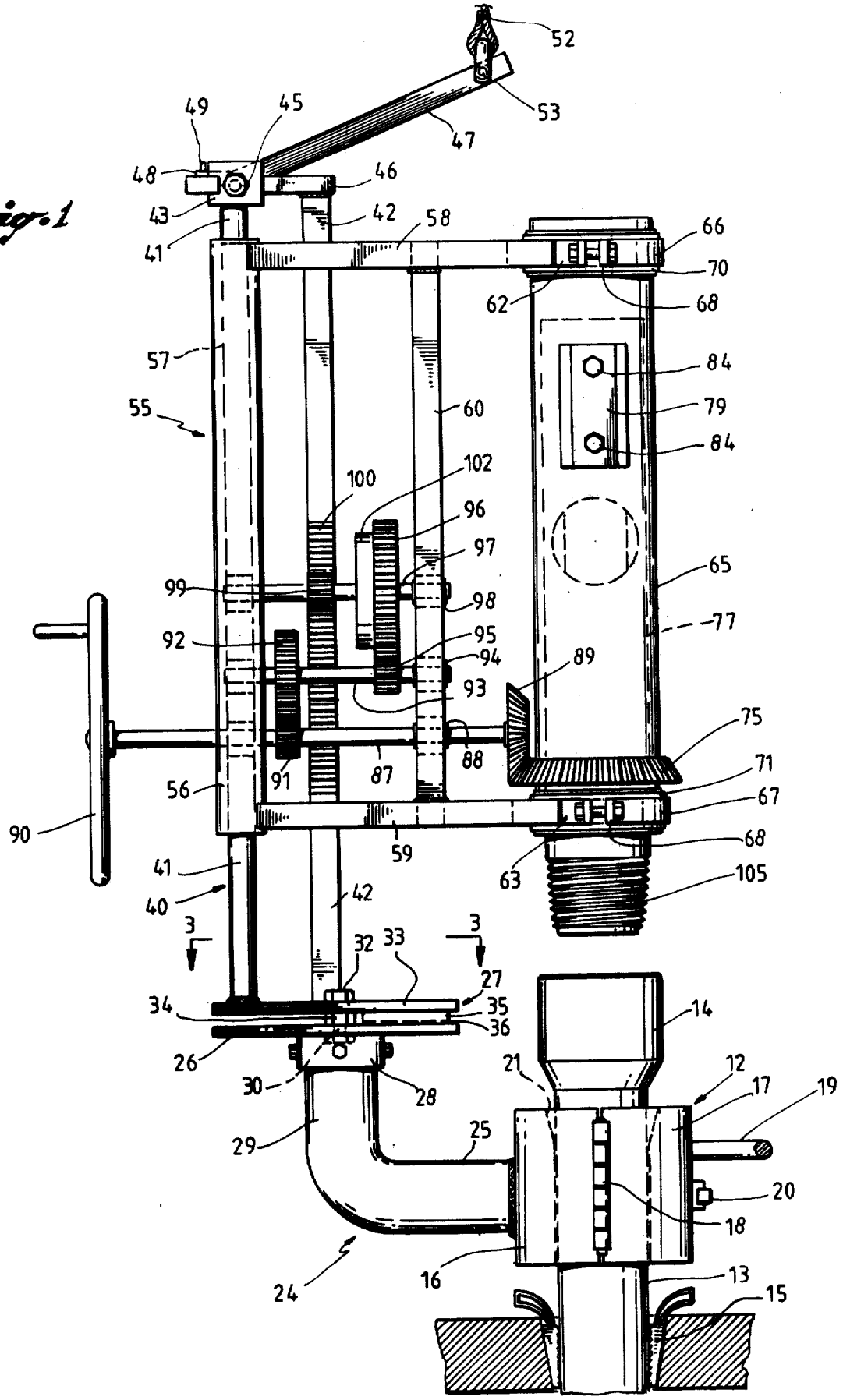
FIG. 1 is a side view of the present invention with the clamp assembly releasably attached to the upper end of the drill pipe.

Referring initially to FIG. 1, an apparatus that is constructed in accordance with the principles of the present invention is shown as including a clamp assembly indicated generally at 12 that is arranged to be positioned around the upper end portion of a joint of drill pipe 13 below the internally threaded box end 14 thereof. The drill pipe joint 13 is suspended by slips 15 in the rotary table on the floor of the derrick. The clamp assembly 12 has a rear section 16 to which two front sections 17 are attached by hinges 18 on each side, and handles 19 are provided on each front section so that an operator can quickly position the clamp assembly 12 around the drill pipe and close the hinged sections together. When closed, a releasable latch device 20 will automatically engage to lock the clamp assembly 12 onto the drill pipe. The clamp assembly as described thus far is of conventional construction and typically is called an elevator. The central bore of the clamp assembly 12 preferably is provided with an upwardly and outwardly inclined surface 21 at its upper end having a substantially mating taper to that of the lower outer face of the tool joint or box 14 to provide a rigid stop against upward movement. Of course the vertical axis of the bore through the clamp assembly 12 is precisely aligned with the central axis of the drill pipe 13 when the clamp assembly 12 is positioned and closed as shown in FIG. 1.

A bracket 24 that can be made from an L-shaped piece of pipe or the like has the end of its horizontal portion 25 welded to the back face of the rear half 16 of the clamp assembly 12. The bottom plate 26 of a swivel assembly indicated generally at 27 has an annular flange 28 welded to its lower side, and the flange is sized to fit over the vertical portion 29 of the bracket 24 where it is fixed rigidly thereto by bolts or the like. An aperture 30 is formed in the center of the plate 26, and receives a bolt 32 by means of which the top plate 33 of the swivel assembly 27 is rotatably mounted on the bottom plate 26. A spacer 34 such as a nut or the like is positioned on the bolt 32 between the two plates, and the plates are provided with generally radially extending ribs 35 and 36 that abut against one another to provide a stop against pivotal rotation in order to rotationally orient the top plate 33 with respect to the bracket 24 and the clamp 12 for purposes to be described below.

A frame assembly indicated generally at 40 is secured to the top plate 33 and includes a pair of laterally spaced, vertically extending guide rods 41 positioned and welded near the corners of the plate 33. As shown in FIGS. 1 and 3, another component of the frame 40 comprises an elongated rack member 42 having its lower end welded to the plate 33 between the lower ends of the guide rods 41 and somewhat inwardly thereof. The upper ends of the guide rods 41 are fitted into end caps 43 which have a pivot shaft 44 extending therebetween as shown in FIG. 2, with the caps, rods and pivot shaft being held rigidly together by a bolt 45 that passes through aligned openings therein. A top plate 46 which is welded to the caps 43 also has the upper end of the rack member 42 secured thereto, with the guide rods 41 and the rack member 42 extending parallel to one another. The plate 46 extends somewhat to the rear of the end caps 43, and a lever 47 that functions as a bail by means of which the apparatus can be suspended in the derrick on a flexible line is coupled to the frame assembly by the shaft 44. The lower end of the lever 47 has an angled portion 48 with a threaded aperture which receives an adjusting stud 49 which bears against the top surface of the plate 46. Through adjustment of the stud 49, the angle of the lever with respect to the plane of the top plate 46 can be changed in order that the apparatus can be caused to hang in a substantially vertical position from the flexible line 52 which is attached by suitable means 53 to an eye in the outer end of the lever 47.

A carriage indicated generally at 55 in FIG. 1 is arranged to move vertically relative to the frame 40. The carriage 55 includes two guide tubes 56 that are slidably mounted on the rods 41, and which have a vertical panel or back wall member 57 welded therebetween. Pairs of upper and lower arm members 58 and 59 are welded to the respective upper and lower end portions of the guide tubes 56 and extend outwardly therefrom, and a second vertical panel or front wall member 60 has its corners welded to the arms 58, 59 between their ends. The panel members 57 and 60 have aligned openings formed therein which receive the bearings of shafts included in a drive mechanism to be described below. Semicircular clamp members 62 and 63 are secured by welding or the like to the respective outer ends of the arms 58 and 59.

A tubular canister 65 open at each end is removably attached to the outer end of the arms 59 and 58 by additional semicircular clamp members 66, 67 that have outwardly extending ears 68 to which bolts are passed as shown in FIGS. 1 and 2. The canister 65, shown in section in FIG. 4, is provided with upper and lower bearing rings 70 and 71 which are rotatable relative to the canister and which are mounted between fixed pairs of retainer rings 72 and 73. A bevel gear 75 encircles the canister 65 above the lower bearing ring 71, and is fixed thereto by allen screws 76 or the like. In order to rigidly mount a flow control device 77 such as the ball-type kelly valve illustrated, for example, at pages 49, 52 of the 1974–75 edition of the *Composite Catalog of Oilfield Equipment and Services*, which disclosure is incorporated herein by reference, a plurality of circumferentially spaced, rectangular openings 78 are cut through the walls of the canister 65, and an arcuate dye holder 79 is welded to the exterior of the canister over each opening. Each dye holder 79, as shown in FIG. 5, has an elongated internal recess 80 that together with the window 78 receives a gripping member or die 81 having a toothed or serrated inner surface 82. Threaded bolt holes 83 are provided in each dye holder 79 and receive studs 84 that bear against the outer walls of the gripping members 81 and force them radially inward into contact with the outer wall surfaces of the housing of the flow control device 77. With the gripping members 81 forced against the flow control device 77, it is fixed tightly within the canister 65 and will rotate therewith. An opening 85 through the wall of the canister 65 at its central region provides access to the actuator socket of the ball valve 77 so that an actuator handle (not shown) can be inserted and used to rotate the ball valve between its open and closed positions.

In order to rotate the canister 65, and the flow control device 77 housed therein, as well as to shift the canister and its associated carriage 55 vertically with respect to the frame 40, a drive mechanism is provided as shown in FIG. 1. The drive mechanism includes a transverse shaft 87 mounted in bearings 88 and the respective panels 57 and 60, the shaft having a bevel gear 89 mounted on one end that meshes with the bevel gears 75 on the canister 65, and a hand wheel 90 on its other end. Thus rotation of the hand wheel 90 will cause corresponding rotation of the canister 65 within the bearings 70 and 71. A pinion 91 keyed to the shaft 87 meshes with the ring gear 92 on an intermediate stub shaft 93, which also is mounted by bearings 94 in the panels 57 and 60. Another pinion 95 keyed to the stub shaft 93 meshes with a ring gear 96 on a drive shaft 97 which is mounted on the panels 57 and 60 by bearings 98, and which carries a pinion 99 that meshes with the gear teeth 100 of the vertically extending rack member 42. If desired, a torque limiting device 102 can be included in the drive train to provide for slippage when a predetermined torque value is exceeded. The limiting device 102, while not shown in detail, can include arcuate brake shoes carried on an outer housing that are pressed by adjustable studs inwardly against a circular brake surface mounted on the shaft 97.

OPERATION

The apparatus assembled as shown in the drawings is hung in the derrick of a drilling rig by the flexible line 52 so as to be out of the way of normal activities but ready for use in the event of an emergency. The flow control valve 77 with its ball valve element in the open position as shown in phantom lines in FIG. 1 will have been mounted in the canister 65 as previously described with the lower threaded end 105 of the valve housing extending below the lower end of the canister 65. Of course a thread for the lower end of the flow control device 77 will have been selected to match the threads of the drill pipe 13 being run into or pulled from the well. The entire upper portion of the assembly including the frame 40, the carriage 55 and the canister 65 will be pivoted at the swivel plate assembly 27 so that the canister 65 is angularly offset from the vertical axis of the clamp assembly 12.

In the event that the well kicks, or other indication is observed that the well may not be under control, of course the blowout preventers can be closed about the drill pipe 13 to seal off the annulus. In order to shut off upward flow of fluids through the drill pipe 13, the apparatus of the present invention is swung into position adjacent the upper end thereof, and the clamp assembly 12 is attached and automatically latched as shown in the drawings. Then the upper portion of the apparatus is pivoted about the axis defined by the bolt 32 until the stop rails 35, 36 come into abutting contact. In such position, the axial center line of the canister 65 is vertically aligned with the longitudinal axis of the drill pipe 13. Then the hand wheel 90 is turned to rotate the canister 65 and to advance the same downwardly toward the threaded box 14 of the drill pipe. As previously mentioned, the valve element of the flow control device 77 is open at this time so that the fluids emanating from the drill pipe 13 can pass upwardly therethrough. Continued operation of the apparatus causes the lower threaded end 105 of the flow control device 77 to be threaded tightly in the box 14 of the drill pipe 13. Once the threaded connection is made, the valve element of the flow control device 77 is rotated to its closed position by manipulation of its actuator handle (not shown) to shut off flow, whereby the well is under control. The number of teeth on the respective gear members are designed such that the product of the number of teeth on gears 75, 92, 96 and 100 divided by the product of the number of teeth on the gears 89, 91, 95, and 99 is equal to a constant which is a function of the pitch of the threads on the lower end portion 105 of the safety valve housing and the threads on the interior of the box 14 of the drill pipe 13.

The bearings 88, 94 and 98, as well as the bearings which may be positioned within the guide tubes for sliding contact with the rods 41 preferably include TEFLON rings that provide for relatively friction-free operation and which are corrosion resistant. The bearings 70 and 71 on the canister are made of like material.

It now will be recognized that a new and improved safety apparatus has been provided that can be quickly and conveniently attached to the upper end of the drill pipe in the event of an emergency and which enables a valve to be threaded into the pipe and then closed to prevent upward flow of well fluids. The upper portion of the apparatus including the canister and safety valve are mounted on a swivel base so that latching of the clamp assembly can be accomplished with the valve out of the flow stream. Once the clamp assembly is secured to the drill pipe, the canister and valve can be pivoted into position over the drill pipe, and the hand wheel operated to cause the valve to be lowered and threaded into the box end or the drill pipe. It will be noted that with the valve closed, the canister can be removed, having the valve in the string, and that more pipe can be added by threading into the upper end of the valve housing and snubbing the pipe string into the well.

Since certain changes or modifications may be made in the disclosed embodiment without departing from the inventive concepts involved, it is the aim of the appended claims to cover all such changes and modifications falling within the true spirit and scope of the present invention.

What is claimed is:

1. Apparatus for use in shutting off upward flow from a conduit extending into a well, said conduit having a threaded joint at its upper end, comprising: clamp means adapted to be removably attached to said conduit adjacent and below said threaded joint; bracket means on said clamp means including a swivel base defining a vertical pivot axis that is laterally offset from and parallel to the longitudinal axis of said clamp means; an upstanding frame assembly pivotally mounted on said swivel base; carriage means slidably mounted on said frame assembly and movable vertically with respect thereto, tubular canister means rotatably mounted on said carriage means and adapted to house a flow control device, said carriage means, frame assembly and canister being arranged to be pivoted about said vertical pivot axis between a first position where said canister is misaligned with said conduit and a second position where the longitudinal axis of said canister is aligned with the longitudinal axes of said clamp means and conduit; and drive means for simultaneously rotating said canister and lowering the same toward said clamp means to automatically thread a flow control device into the threaded joint of said conduit, whereby the flow control device can be actuated to shut off upward flow through the conduit.

2. The apparatus of claim 1 further including stop means on said frame assembly and said swivel base for rotationally orienting said canister with respect to said clamp means such that the respective axes thereof are in longitudinal alignment.

3. The apparatus of claim 1 wherein said frame assembly includes elongated guide rods, said carriage means having guide tubes slidably mounted on said rods and including transversely extending arm means having inner and outer ends, said inner ends of said arm means being fixed to said guide tubes, said canister being mounted in bearing means on the outer end of said arm means.

4. The apparatus of claim 3 further including means for removably attaching said canister to said outer ends of said arm means.

5. The apparatus of claim 1 further including gripping means for securing a flow control device within the bore of said canister.

6. The apparatus of claim 5 wherein said gripping means includes radially movable dies mounted in windows cut through the wall of said canister, and adjustable means for forcing said dies against outer peripheral surfaces of a flow control device mounted within the bore of said canister.

7. The apparatus of claim 1 wherein said drive means includes a shaft mounted on said carriage means and having a bevel gear on one end meshed with a bevel gear on said canister so that rotation of said shaft causes corresponding rotation of said canister, said frame assembly including a rack member having gear teeth, and gear train means coupled between said shaft and said toothed rack whereby rotation of said shaft also causes vertical movement of said carriage means and said canister relative to said frame assembly and said clamp means.

8. The apparatus of claim 7 wherein said gear train means includes means for limiting the make-up torque that can be applied in threading a flow control device into the threaded joint of said conduit.

9. The apparatus of claim 1 wherein said clamp means has upwardly facing inclined surface means at the upper end of its bore arranged to engage downwardly facing inclined surface means on the threaded joint of said conduit for limiting upward movement of said clamp means.

10. The apparatus of claim 1 further including means on the upper end of said frame assembly for suspending said apparatus within the derrick of a drilling rig.

11. Apparatus for use in shutting off upward flow from a pipe extending into a well, said pipe having a threaded upper end, comprising: elevator means having hinged segments adapted to be releasably secured to said pipe below said threaded upper end, said elevator means including latch means for closing said segments around said pipe; a bracket having a horizontal portion attached to said elevator means and a vertical portion; a base plate mounted on said vertical portion and defining a vertical pivot axis that is laterally offset from and parallel to the longitudinal axes of said elevator means and pipe; an upstanding frame assembly including a swivel plate pivotally mounted to said base plate, a pair of guide rods and a toothed rack member having their lower ends attached to said swivel plate and their upper ends secured to a top plate; carriage means slidably mounted on said frame assembly and including guide tubes mounted on said rods, upper and lower arm means having their outer ends secured to said guide tubes; a tubular canister rotatably mounted on the inner ends of said arm means and having a bevel gear thereon, said canister, carriage means and frame assembly being arranged for pivotal movement from a position where longitudinal axis of said canister is aligned with the longitudinal axis of said pipe and a position where said canister and pipe are misaligned; normally open safety valve means mounted in said canister and having a threaded lower end adapted to be screwed into the threaded upper end of said pipe; and gear drive means cooperable with said rack member and said bevel gear for rotating said canister and safety valve means while lowering the same toward said pipe to automatically make up a threaded connection between the threaded ends of said valve means and pipe, whereupon said valve means can be closed to shut off upward flow through said pipe.

12. The apparatus of claim 11 further including abutment means on said base plate and said swivel plate for stopping pivotal movement of said canister, carriage means and frame assembly with the longitudinal axes of said canister and pipe in vertical alignment.

13. The apparatus of claim 11 further including releasably clamp means for securing said canister to the inner ends of said arm means.

14. The apparatus of claim 13 further including gripping means for mounting said valve means within said canister, said gripping means comprising laterally shiftable members having serrated inner surfaces engageable with outer peripheral surfaces of said valve means, and means for forcing said gripping means against said surfaces to cause said valve means to rotate with said canister.

15. The apparatus of claim 11 wherein said gear drive means includes a first shaft mounted on said frame assembly and having a bevel gear meshed with said bevel gear on said canister, a second shaft mounted on said frame assembly and having a pinion gear meshed with the gear teeth on said rack member, and gear train means for coupling said first and second shafts in driving relation to one another.

16. The apparatus of claim 11 further including means attached to said top plate of said frame assembly for suspending said apparatus on a flexible line within the derrick of a drilling rig.

17. The apparatus of claim 16 wherein said suspending means comprises a lever pivotally secured at an angle to said top plate, and means for adjusting the angle between said lever and said top plate.

* * * * *